US006933049B2

(12) United States Patent
Wan et al.

(10) Patent No.: US 6,933,049 B2
(45) Date of Patent: Aug. 23, 2005

(54) ABRASIVE TOOL INSERTS WITH DIMINISHED RESIDUAL TENSILE STRESSES AND THEIR PRODUCTION

(75) Inventors: Shan Wan, Lewis Center, OH (US); Eoin M. O'Tighearnaigh, Kalmthout (BE); Therese Raftery, Columbus, OH (US); Rosemarie Shelly Snyder, Millersport, OH (US); Gary Martin Flood, Canal Winchester, OH (US)

(73) Assignee: Diamond Innovations, Inc., Worthington, OH (US)

( * ) Notice: Subject to any disclaimer, the term of this patent is extended or adjusted under 35 U.S.C. 154(b) by 0 days.

(21) Appl. No.: 10/458,903

(22) Filed: Jun. 11, 2003

(65) Prior Publication Data

US 2004/0009376 A1 Jan. 15, 2004

Related U.S. Application Data

(60) Provisional application No. 60/395,182, filed on Jul. 10, 2002.

(51) Int. Cl.[7] ..... B32B 9/00

(52) U.S. Cl. ..... 428/408; 51/307; 51/309; 175/426; 175/434; 428/698; 428/704

(58) Field of Search ..... 428/408, 698, 428/704; 51/307, 309; 175/426, 434

(56) References Cited

U.S. PATENT DOCUMENTS

| | | | | |
|---|---|---|---|---|
| 3,136,615 | A | 6/1964 | Bovenkerk et al. | 51/307 |
| 3,141,746 | A | 7/1964 | De Lai | 51/307 |
| 3,233,988 | A | 2/1966 | Wentorf, Jr. et al. | 51/307 |
| 3,743,489 | A | 7/1973 | Wentorf, Jr. et al. | 51/307 |
| 3,745,623 | A | 7/1973 | Wentorf, Jr. et al. | 29/95 |
| 3,767,371 | A | 10/1973 | Wentorf, Jr. et al. | 51/307 |
| 4,109,737 | A | 8/1978 | Bovenkerk | 175/329 |
| 4,784,023 | A | 11/1988 | Dennis | 76/108 |
| 4,972,637 | A | 11/1990 | Dyer | 51/295 |
| 5,007,207 | A | 4/1991 | Phaal | 51/204 |
| 5,351,772 | A | 10/1994 | Smith | 175/428 |
| 5,484,330 | A | 1/1996 | Flood et al. | 451/540 |
| 5,486,137 | A | 1/1996 | Flood et al. | 451/540 |
| 5,494,477 | A | 2/1996 | Flood et al. | 451/540 |
| 5,605,199 | A | 2/1997 | Newton | 175/432 |
| 5,743,346 | A | 4/1998 | Flood et al. | 175/420.2 |
| 5,971,087 | A | 10/1999 | Chaves | 175/432 |
| 2001/0037901 | A1 | 11/2001 | Bertagnoili et al. | 175/420 |

*Primary Examiner*—Archene Turner
(74) *Attorney, Agent, or Firm*—Pepper Hamilton LLP

(57) ABSTRACT

An abrasive tool insert includes (a) a substrate having a support face that includes (1) an inner support table, (2) an outer shoulder having a width, $S_w$, and (3) a downwardly sloping interface from the support table to the shoulder, which interface has a slope angle, $S_a$. A continuous abrasive layer, integrally formed on the substrate support face, includes (1) a center having a height, $D_c$, (2) a diameter, $D_d$, (3) a periphery having a height, $D_p$, in contact with the shoulder and which periphery forms a cutting edge. $S_w$:$D_d$ ranges from between 0 and about 0.5. For each $S_a$ and $S_w$:$D_d$, $D_c$:$D_p$ is selected so as to diminish residual stress in the abrasive layer.

18 Claims, 6 Drawing Sheets

ABRASIVE TOOL INSERTS WITH DIMINISHED RESIDUAL TENSILE STRESSES AND THEIR PRODUCTION

CROSS-REFERENCE TO RELATED APPLICATIONS

This application claims priority on U.S. Provisional Application Ser. No. 60/395,182, filed on Jul. 10, 2002.

FIELD OF THE INVENTION

The present invention relates to the field of abrasive tool inserts and, more particularly, to such inserts having minimized residual tensile stresses.

BACKGROUND OF THE INVENTION

Abrasive compacts are used extensively in cutting, milling, grinding, drilling and other abrasive operations. An abrasive particle compact is a polycrystalline mass of abrasive particles, such as diamond and/or cubic boron nitride (CBN), bonded together to form an integral, tough, high-strength mass. Such components can be bonded together in a particle-to-particle self-bonded relationship, by means of a bonding medium disposed between the particles, or by combinations thereof. The abrasive particle content of the abrasive compact is high and there is an extensive amount of direct particle-to-particle bonding. Abrasive compacts are made under elevated or high pressure and temperature (HP/HT) conditions at which the particles, diamond or CBN, are crystallographically stable. For example, see U.S. Pat. Nos. 3,136,615, 3,141,746, and 3,233,988.

A supported abrasive particle compact, herein termed a composite compact, is an abrasive particle compact, which is bonded to a substrate material, such as cemented tungsten carbide.

Abrasive compacts tend to be brittle and, in use, they frequently are supported by being bonded to a cemented carbide substrate. Such supported abrasive compacts are known in the art as composite abrasive compacts. Compacts of this type are described, for example, in U.S. Pat. Nos. 3,743,489, 3,745,623, and 3,767,371. The bond to the support can be formed either during or subsequent to the formation of the abrasive particle compact. Composite abrasive compacts may be used as such in the working surface of an abrasive tool.

Composite compacts have found special utility as cutting elements in drill bits. Drill bits for use in rock drilling, machining of wear resistant materials, and other operations which require high abrasion resistance or wear resistance generally consist of a plurality of polycrystalline abrasive cutting elements fixed in a holder. U.S. Pat. No. 4,109,737 describes drill bits with a tungsten carbide stud (substrate) having a polycrystalline diamond compact on the outer surface of the cutting element. A plurality of these cutting elements then are mounted generally by interference fit into recesses into the crown of a drill bit, such as a rotary drill bit. These drill bits generally have means for providing water-cooling or other cooling fluids to the interface between the drill crown and the substance being drilled during drilling operations. The cutting element comprises an elongated pin of a metal carbide (stud) which may be either sintered or cemented carbide (such as tungsten carbide) with an abrasive particle compact (e.g., polycrystalline diamond) at one end of the pin for form a composite compact.

Fabrication of the composite compact typically is achieved by placing a cemented carbide substrate into the container of a press. A mixture of diamond grains or diamond grains and catalyst binder is placed atop the substrate and compressed under HP/HT conditions. A composite compact formed in the above-described manner may be subject to a number of shortcomings. For example, the coefficients of thermal expansion and elastic constants of cemented carbide and diamond are close, but not exactly the same. Thus, during heating or cooling of the polycrystalline diamond compact (PDC), thermally induced stresses occur at the interface between the diamond layer and the cemented carbide substrate, the magnitude of these stresses being dependent, for example, on the disparity in thermal expansion coefficients and elastic constants. Another potential shortcoming relates to the creation of internal stresses within the diamond layer, which can result in a fracturing of that layer. Such stresses also result from the presence of the cemented carbide substrate and are distributed according to the size, geometry, and physical properties of the cemented carbide substrate and the polycrystalline diamond layer. In some applications, the tools are subject to delamination failures caused by thermally induced axial residual stresses on the outer diameter of the superabrasive layer. The stresses reduce the effectiveness of the tools and limit the applications in which they can be used.

Various PDC structures have been proposed in which the diamond/carbide interface contains a number of ridges, grooves, or other indentations aimed at reducing the susceptibility of the diamond/carbide interface to mechanical and thermal stresses. In U.S. Pat. No. 4,784,023, a PDC includes an interface having a number of alternating grooves and ridges, the top and bottom of which are substantially parallel with the compact surface and the sides of which are substantially perpendicular to the compact surface.

U.S. Pat. No. 4,972,637 proposes a PDC having an interface containing discrete, spaced-apart recesses extending into the cemented carbide layer, the recesses containing abrasive material (e.g., diamond) and being arranged in a series of rows, each recess being staggered relative to its nearest neighbor in an adjacent row. U.S. Pat. No. 5,007,207 proposes an alternative PDC structure having a number of recesses in the carbide layer, each filled with diamond, which recesses are formed into a spiral or concentric circular pattern.

U.S. Pat. No. 5,486,137 proposes a tool insert having an outer downwardly sloped interface surface. U.S. Pat. No. 5,483,330 proposes a sawtooth shaped cross-sectional profile and U.S. Pat. No. 5,494,477 proposed an outwardly sloping profile in the interface design. U.S. Pat. No. 5,605,199 proposes a profile comprising an peripheral region with inclined inner surface surrounding an inner region. U.S. Pat. No. 6,315,652 proposes an abrasive tool insert having an interface formed in a sawtooth pattern of concentric rings extending from said center to the periphery.

There is still a need in the art to minimize susceptibility to fracture and spall in the diamond layer of cutting tools, which in part arises from the internal residual stresses. Thus it would be highly desirable to provide a polycrystalline diamond compact having increased resistance to diamond spalling fractures.

BRIEF SUMMARY OF THE INVENTION

The present invention relates to an abrasive tool insert which comprises a substrate having a support face that includes: an inner support table; an outer shoulder having a width, $S_w$; a downwardly sloping interface from the support table to the shoulder which interface has a slope angle, $S_a$;

and a continuous abrasive layer integrally formed on the substrate support face, which abrasive layer includes: (a) a center having a height, $D_c$; (b) a diameter, $D_d$; (c) a periphery having a height, $D_p$, in contact with the shoulder and which periphery forms a cutting edge; wherein, (i) $S_w$:$D_d$ ranges from between 0 and about 0.5; and (ii) for each $S_a$ and $S_w$:$D_d$, $D_c$:$D_p$ is selected so as to diminish residual stress in the abrasive layer.

The present invention further relates to a method of manufacturing abrasive tool inserts that possess diminished residual stress.

DETAILED DESCRIPTION OF THE INVENTION

Figure 1:
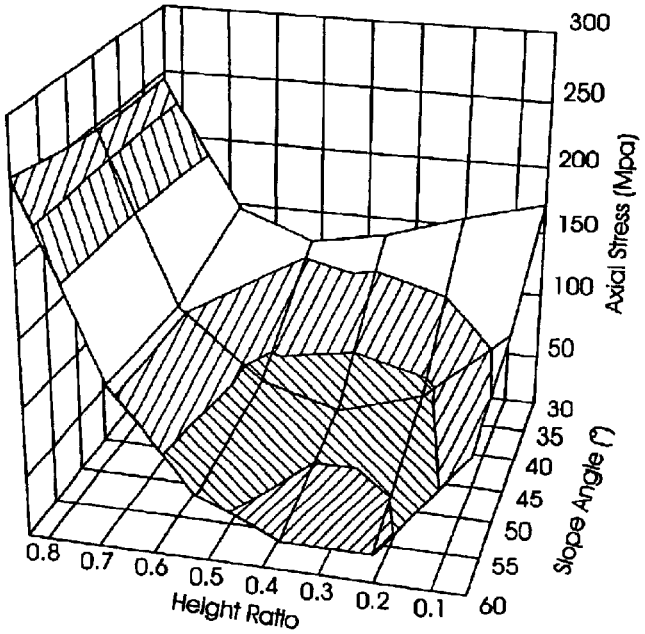
FIG. 1 graphically plots axial stress as a function of both slope angle and height ratio for a PCD tool insert.

The present invention is based on several relationships regarding residual stresses in cutting tool inserts that have eluded the art. Applicants have found a number of features including the slope angle of the diamond/substrate interface, which features not known in the prior art, which greatly affect the overall residual stresses in the cutting tool insert. In one embodiment of the invention, the height ratio between the center diamond table thickness and the periphery thickness can change the overall stress as it interacts with the slope angle. Moreover, the diamond table thickness also has a strong effect on these factors in other embodiments of the invention.

The cutting tool insert, or cutter, may be manufactured, in one embodiment by fabricating a cemented carbide substrate in a generally cylindrical shape. The cemented metal carbide substrate is conventional in composition and, thus, may be include any of the Group IVB, VB, or VIB metals, which are pressed and sintered in the presence of a binder of cobalt, nickel or iron, or alloys thereof. Examples include carbides of tungsten (W), niobium (Nb), zirconium (Zr), vanadium (V), tantalum (Ta), titanium (Ti), tungsten Ti) and hafnium (Hf). In one embodiment, the metal carbide is tungsten carbide. The end face(s) on the carbide substrate are formed by any suitable cutting, grinding, stamping, or etching process.

A sufficient mass of superabrasive material is then placed on the substrate forming the upper abrasive layer. In one embodiment, the upper layer is polycrystalline diamond (PCD). In another embodiment, the upper abrasive layer comprises at least one of synthetic and natural diamond, cubic boron nitride (CBN), wurtzite boron nitride, combinations thereof, and like materials.

In one embodiment, the polycrystalline material layer (or the diamond table layer) and the substrate are subjected to pressures and temperatures sufficient to effect intercrystalline bonding in the polycrystalline material, and create a solid polycrystalline material layer. In another embodiment, chemical vapor deposition may also be used to deposit the polycrystalline material on the substrate. This is accomplished by coating the particles of the individual diamond crystals with various metals such as tungsten, tantalum, niobium, or molybdenum, and the like by chemical vapor techniques using fluidized bed procedure. Chemical vapor deposition techniques are also known in the art which utilize plasma assisted or heated filament methods.

Applicants have conducted three dimensional finite element stress analyses ("FEA"), and found that for a normal diamond-cutting tool, there exist some high tensile stress zones on the diamond table surface and near the interface. Specifically, the tensile axial stress above the interface is a significant factor causing delamination, and the high radial stress on the diamond table surface can lead to center-splitting type failure. Therefore, to reduce the impact related failure and improve the useful working time of PCD cutting tool, the residual stresses should be minimized.

In one embodiment of the invention, maximum axial, radial, and hoop tensile stresses can be greatly reduced by introducing the outwardly slope with proper height ratio between center diamond table thickness and periphery thickness. For a given slope angle, $S_a$, there is an optimized height ratio range of PCD center thickness to PCD cutting edge (periphery) thickness, $D_c$:$D_p$, to achieve minimized diamond table surface stresses. This is illustrated in FIGS. 1 and 2.

Figure 2:
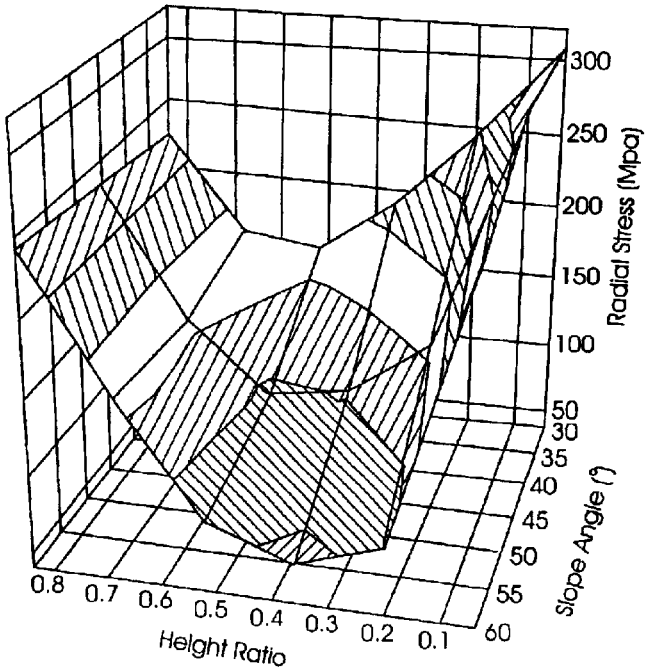
FIG. 2 graphically plots radial stress as a function of both slope angle and height ratio for a PCD tool insert.

FIGS. 1 and 2 display the maximum surface axial stress and radial stress dependent on the slope angle and the height ratio from one FEA study. The hoop stress is not shown here because it is much smaller than axial and radial stresses. As seen in FIGS. 1 and 2, the optimum range for minimum axial and radial stresses is very close. In one embodiment for a height ratio of larger than about 0.25, a larger slope angle generally leads to smaller stress. In another embodiment, the optimum slope angle is between about 40° and about 50°, as higher angles tend to cause manufacturing difficulty. For a given slope angle, there exists a range of height ratios corresponding to minimum residual tensile stress.

Figure 3:
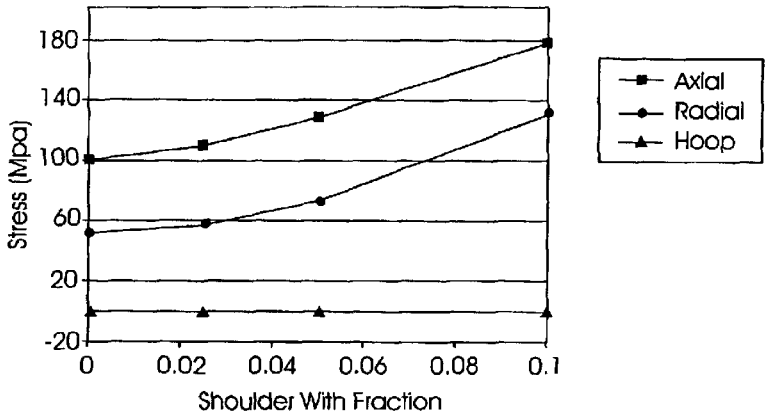
FIG. 3 graphically plots stress as a function of should width fraction for a PCD tool insert.

In another embodiment of the invention, a factor that affects residual stresses in cutting tools is the shoulder width ($S_w$) fraction of the radius of diamond table diameter ($D_d$). As illustrated in FIG. 3, the residual stress increases with shoulder width fraction. However, the shoulder can provide the better shaping capability and flexibility for post-sintering finishing. In one embodiment, the shoulder width fraction ranges from between about 0.02 and 0.05.

Besides the optimized embodiment of a planar interface between the substrate and the polycrystalline diamond table, the interface can vary in a number of ways to ensure better bonding strength and manufacturing feasibility. This has been demonstrated in the art listed above. For example, the center interface can be slightly concave or convex, and some non-planar patterns can be combined with the outwardly sloped design. As long as the outwardly slope interface for the cutting tool is optimized based on the precepts of the present invention, the residual stresses can be minimized.

In one embodiment of the invention, the cutting tool inserts are based on cylindrical supports having a diameter that ranges from between about 6 and 30 mm. This also is the nominal diameter, $D_d$, of the abrasive compact upper surface. In another embodiment, the height of the abrasive particle at its periphery, $D_p$, ranges from about 3 to about 6 mm in thickness. Using a practical $S_w$:$D_d$ ratio of about 0.1 to about 0.5, translates into the shoulder, $S_w$, having a width of from between about 0.003 and about 0.083 mm.

In one embodiment, the slope angle, $S_a$, ranges from about 40° to 50°. At this slope angle, $D_c$:$D_p$ ranges from between about 0.1 and 0.8. In a second embodiment, the $D_c$:$D_p$ ratio ranges from about 0.2 and 0.7. In a third embodiment, the $D_c$:$D_p$ ratio ranges from between about 0.3 and 0.6. In a fourth embodiment, the $D_c$:$D_p$ ratio ranges from about 0.4 and 0.5.

Figure 4:
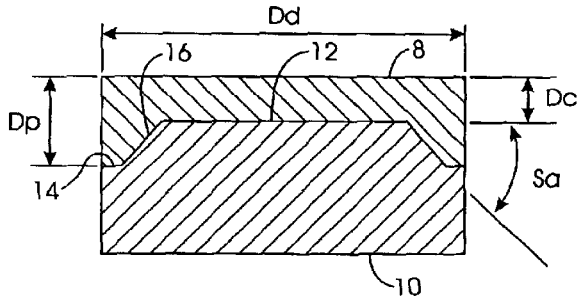
FIG. 4 is a cross-sectional elevational view of a tool insert showing its various components: substrate having an inner support table, an outer shoulder, and a downwardly sloping interface therebetween; and a continuous abrasive layer having a center, a diameter, and a periphery.
Figure 5:
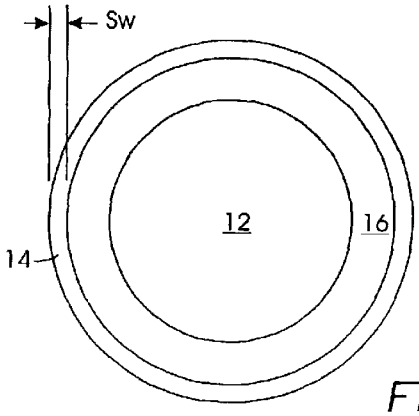
FIG. 5 is a top plan view of the support of the tool insert of FIG. 4.
Figure 6:
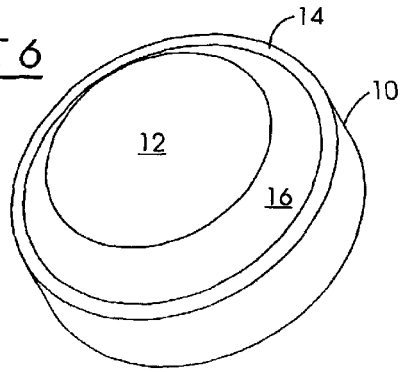
FIG. 6 is a perspective view of the support of FIG. 5.

In one embodiment of a planar interface model cutting tool insert as illustrated in FIGS. 4–6, wherein a diamond table, 8, has a diameter, $D_d$; a diamond table periphery thickness, $D_p$; a diamond table center thickness, $D_c$; a slope angle, $S_a$; and a shoulder width, $S_w$. The illustrated cutting tool insert has a substrate, 10, that has a support face, which includes an inner support table, 12, an outer shoulder, 14, and a downwardly sloping (from support table 12) interface, 16, that forms a slope angle, $S_a$, between support table 12 and shoulder 14. In this embodiment, support table 12 and shoulder 14 are planar, while interface 16 is linear between support table 12 and shoulder 14. It will be appreciated that the interface between diamond table 8 and support 10 are mirror images. In manufacturing, the interface of diamond table 8 will confirm to the interface of support 10.

Figure 7:
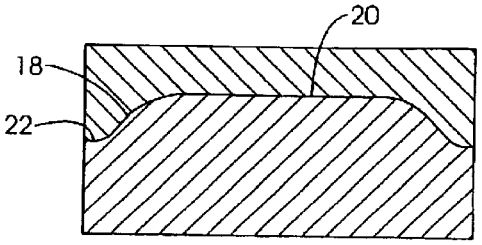
FIG. 7 is a cross-sectional elevational view of a tool insert like FIG. 4, except that the support slope is slightly curved.
Figure 8:
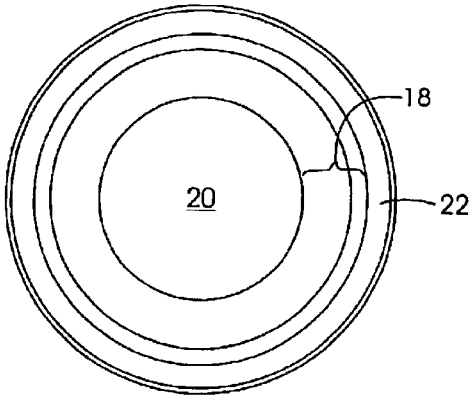
FIG. 8 is a top plan view of the support of FIG. 7.
Figure 9:
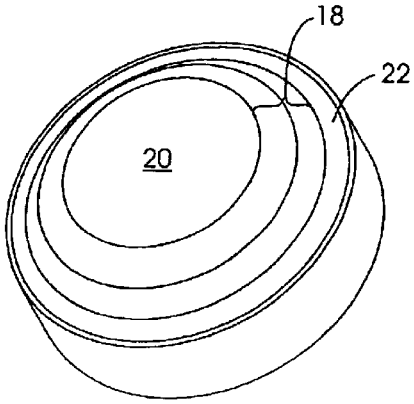
FIG. 9 is a perspective view of the support of FIG. 8.

In another embodiment as illustrated in FIGS. 7–9, the cutting tool insert has a slightly curved sloping interface, 18. As shown in the figure, the interface is slightly curved both at its junction with the inner support table, 20, and with the shoulder, 22.

Figure 10:
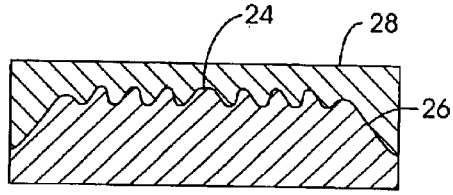
FIG. 10 is a cross-sectional elevational view of a tool insert like FIG. 4, except that the inner support table is concentrically grooved.
Figure 11:
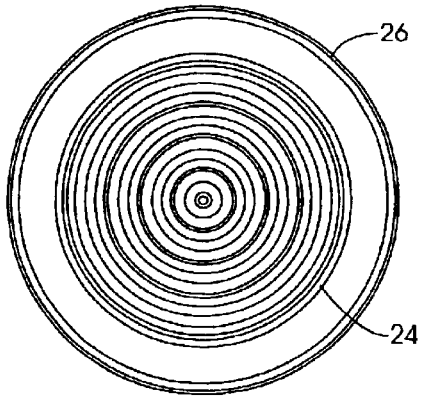
FIG. 11 is a top plan view of the support of FIG. 10.
Figure 12:
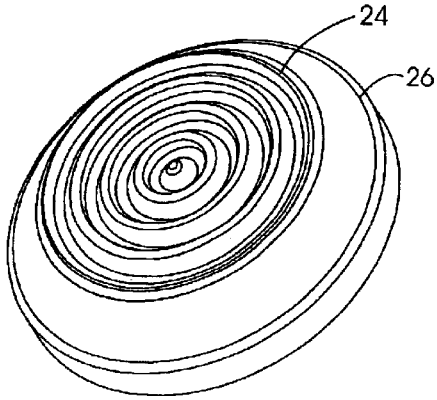
FIG. 12 is a perspective view of the support of FIG. 11.

In yet another embodiment of the inventive cutter as illustrated in FIGS. 10–12, the inner support table 24 of the cutter is concentrically grooved from the center of support table 24, to the sloping interface, 26. In this embodiment, the concentric grooves are intended to provide better support for and a better bond to the diamond table, 28. As shown, the cross-section of these grooves can be of a configuration other than that illustrated.

Figure 13:
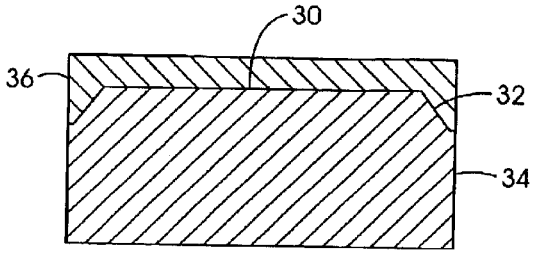
FIG. 13 is a cross-sectional elevational view of a tool insert like FIG. 4, except that the inner support table has outwardly radiating channels.
Figure 14:
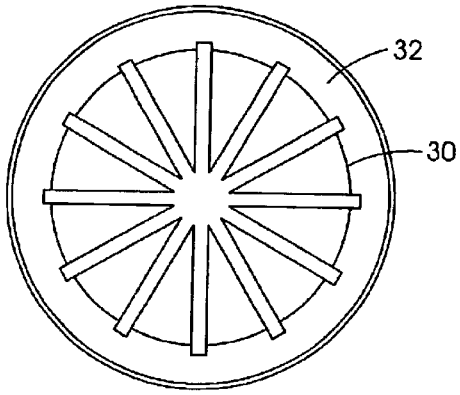
FIG. 14 is a top plan view of the support of FIG. 13.
Figure 15:
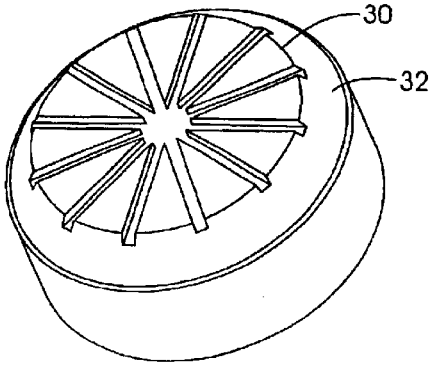
FIG. 15 is a perspective view of the support of FIG. 14.

In yet a fourth embodiment of the interface of the inventive cutter as shown in FIGS. 13–15, the inner support table 30, has a series of channels that radiate from its center to the sloping interface 32. The number of such channels can be lesser or greater than the number shown. Additionally, the depth and height of each channel can vary from channel to channel. In another embodiment that is not shown, the cross-section of these channels need not be rectangular, but can consist of other geometries as well. In this embodiment, the channels in the support substrate 34 serve to provide a better bond for the diamond table 36 that it supports and to which it is bonded. The sloping interface and shoulder can be in any configuration illustrated herein.

Figure 16:
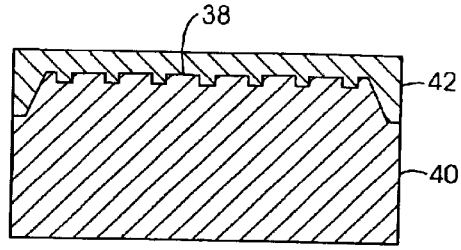
FIG. 16 is a cross-sectional elevational view of a tool insert like FIG. 4, except that the inner support table has a series of generally parallel channels.
Figure 17:
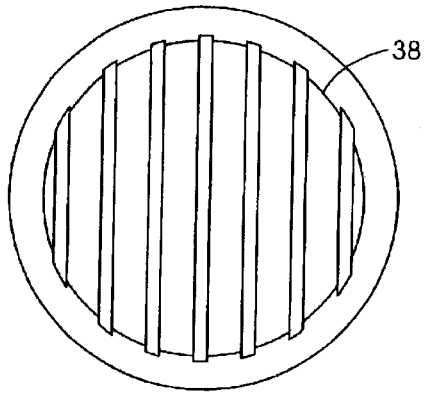
FIG. 17 is a top plan view of the support of FIG. 16.
Figure 18:
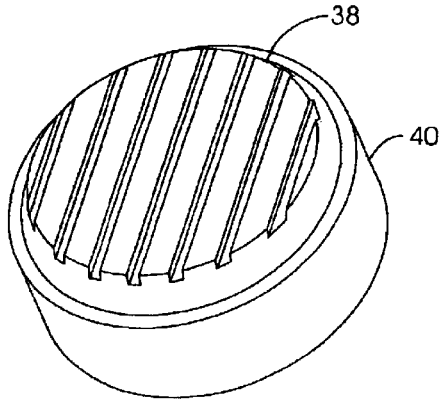
FIG. 18 is a perspective view of the support of FIG. 17

In a fifth embodiment as illustrated in FIGS. 16–18, the cutting tool insert as in previous embodiments, is like the insert of FIG. 4, except that the inner support table 38 of the substrate 40, and the diamond table 42, contain a series of substantially parallel channels across its face. The number of such channels can be lesser or greater than the number shown. The depth and height of each channel can also vary from channel to channel. The cross-section of these channels need not be rectangular, but can consist of other geometries as well. The sloping interface and shoulder can be in any configuration illustrated herein.

Figure 19:
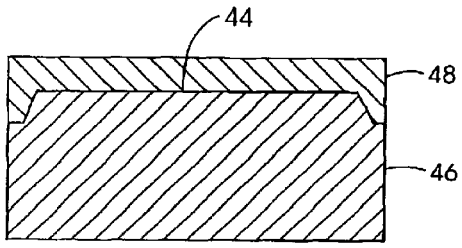
FIG. 19 is a cross-sectional elevational view of a tool insert like FIG. 4, except that the inner support table has a waffle pattern of channels.
Figure 20:
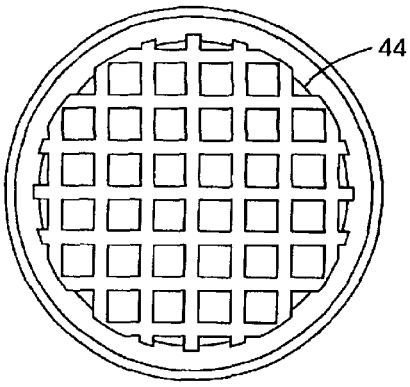
FIG. 20 is a top plan view of the support of FIG. 19.
Figure 21:
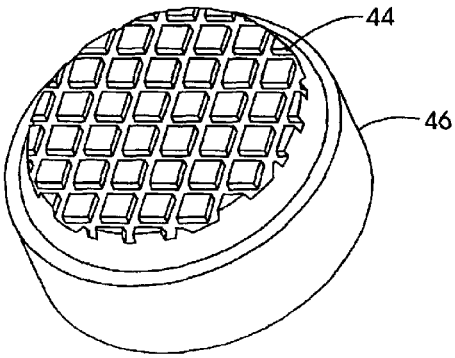
FIG. 21 is a perspective view of the support of FIG. 20.

In a sixth embodiment as illustrated in FIGS. 19–21, the inner support table 44 of the substrate 46 and the diamond table 48, contain a matrix of substantially parallel intersecting channels (a waffle-like pattern) across its face. The number of such channels can be lesser or greater than the number shown, as can the depth and height of each channel, which can vary from channel to channel. It should be noted that the cross-section of these channels need not be rectangular, but can consist of other geometries as well. The sloping interface and shoulder can be in any configuration illustrated herein.

Figure 22:
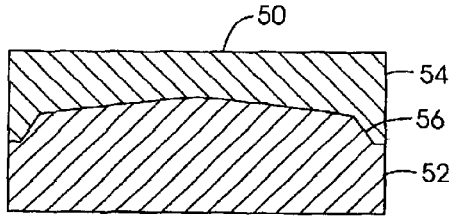
FIG. 22 is a cross-sectional elevational view of a tool insert like FIG. 4, except that the inner support table is concave and has outwardly radiating channels.
Figure 23:
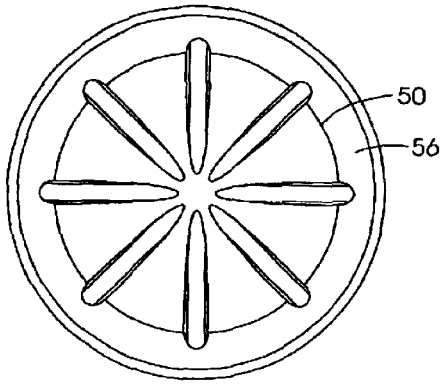
FIG. 23 is a top plan view of the support of FIG. 22.
Figure 24:
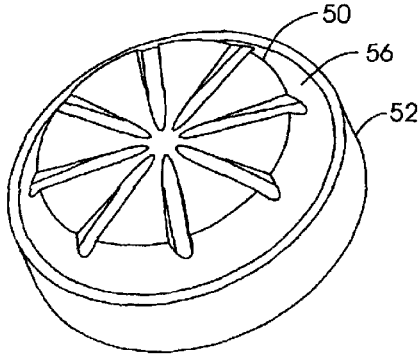
FIG. 24 is a perspective view of the support of FIG. 21.

In a seventh embodiment as shown in FIGS. 22–24, the inner support table 50 of the substrate 52 is domed and contains a series of radiating channels from its center to the sloping interface 56 with the diamond table 54. The number of such channels can be lesser or greater than the number shown, as can the depth and height of each channel, which can vary from channel to channel. In one variation, the cross-section of these channels is not rounded, but can consist of other geometries. Furthermore, the shape of the dome also can vary. The sloping interface and shoulder can be in any configuration illustrated herein.

Figure 25:
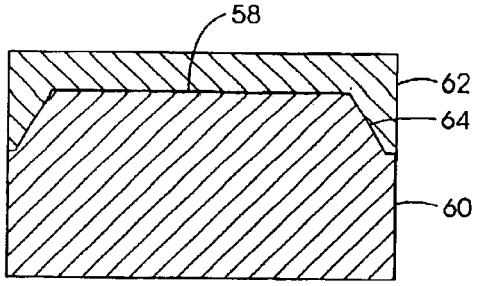
FIG. 25 is a cross-sectional elevational view of a tool insert like FIG. 4, except that the inner support table has outwardly radiating rectangular ridges.
Figure 26:
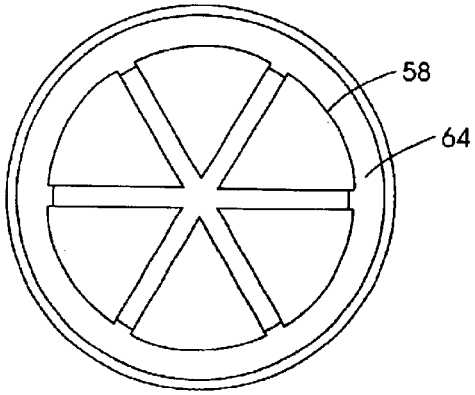
FIG. 26 is a top plan view of the support of FIG. 25.
Figure 27:
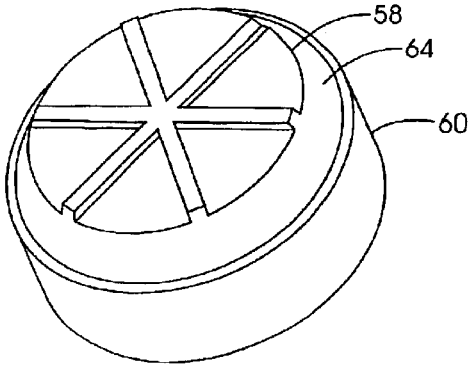
FIG. 27 is a perspective view of the support of FIG. 26.

In an eight embodiment of the inventive cutter as shown in FIGS. 25–27, which is like the insert of FIG. 4, except that the inner support table 58 of the substrate 60 contains a series of raised rectangular ridges that radiate from its center to the sloping interface 64 with the diamond table 62. The number of such ridges can be lesser or greater than the number shown, as can the width and height of each ridge, which can vary from ridge to ridge. The cross-section of these ridges need not be rectangular, but can consist of other geometries as well. The sloping interface and shoulder can be in any configuration illustrated herein.

Figure 28:
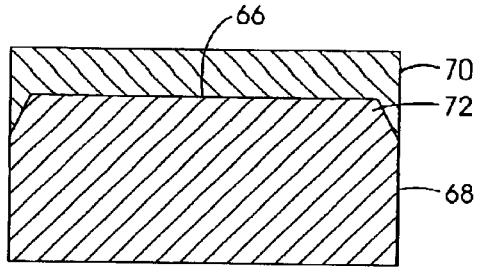
FIG. 28 is a cross-sectional elevational view of a tool insert like FIG. 4, except that the shoulder has a series of radiating raised rectangular ridges.
Figure 29:
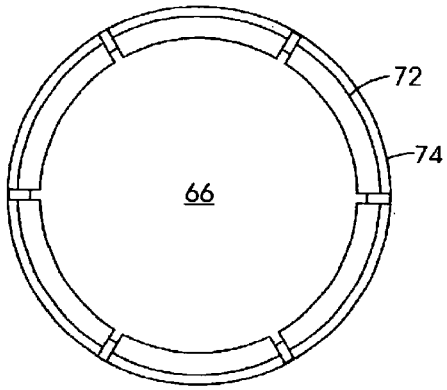
FIG. 29 is a top plan view of the support of FIG. 28.
Figure 30:
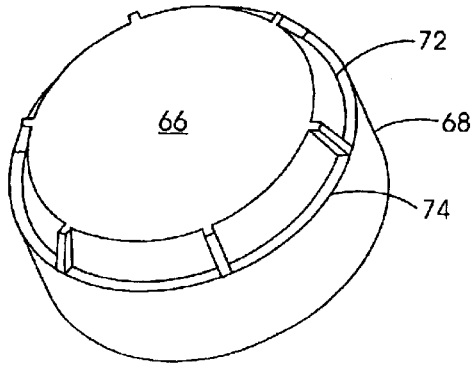
FIG. 30 is a perspective view of the support of FIG. 29.

In the ninth embodiment of the cutting tool insert as shown in FIGS. 28–30, the sloping interface 72 between the inner support table 68 and the diamond table 70 is linear (as in FIG. 4), except that it has a series of radiating raised ridges that extend from support table 66 to the shoulder, 74. The number of such ridges can be lesser or greater than the number shown, as can the width and height of each ridges, which can vary from ridge to ridge. In fact, the cross-section of these ridges need not be rectangular, but can consist of other geometries as well.

In one embodiment of the invention, the inventive cutter demonstrates an increased useful life with the reduced residual stresses (axial, radial, and hoop tensile) in the abrasive layer at locations where spalling and delamination typically occur. In another embodiment, reduced residual stresses is obtained for virtually any size tool insert. In yet another embodiment with optimized diamond-substrate interface, the residual tensile stress in cutting tool inserts is significantly reduced with the axial tensile stress decreased by about 90%, the radial tensile stress decreased by about 60%, and the hoop stress becoming completely compressive. This new residual stress pattern greatly increases the impact resistance and useful working life of diamond cutting tool. These and other advantages will be readily apparent to those skilled in the art.

EXAMPLES

Applicants have performed finite element analysis (FEA) of the inventive cutter versus the prior art polycrystalline diamond cutters (having a flat interface). The cutters are manufactured by conventional high pressure/high temperature (HP/HT) techniques well known in the art. Such techniques are disclosed, inter alia, in the art cited above. The prior art cutter has a flat interface, 19 mm diameter, 16 mm overall height, 3 mm diamond table thickness. The cutter of the invention has an optimized interface of slope angle of 45°,a height ratio of 0.6,and a shoulder width ratio= 0.025.FEA results are shown in Table 1.

TABLE 1

| Stress in MPa | Flat Interface Cutter | Inventive Cutter |
|---|---|---|
| Maximum Surface Tensile Axial Stress | 595 | 58 |
| Maximum Surface Tensile Radial Stress | 300 | 110 |
| Maximum Surface Tensile Hoop Stress | 88 | 0 |

The foregoing results can be extended to additional table diameters, diamond table heights, slope angles, and shoulder widths. Table 2 display correlations of shoulder angle ($S_a$) and diamond table height ratio $D_c$:$D_p$ as predicted by FEA models. The ratios displayed are approximate.

TABLE 2

| Shoulder Angle ($S_a$) | $D_c$:$D_p$ Diamond Table Ratio |
|---|---|
| 20° and 30° | 0.25 and 0.85 |
| 20° and 30° | 0.35 and 0.75 |
| 20° and 30° | 0.45 and 0.65 |
| 20° and 30° | 0.5 and 0.55 |
| 25° and 35° | 0.25 and 0.8 |
| 25° and 35° | 0.3 and 0.7 |
| 25° and 35° | 0.4 and 0.6 |

TABLE 2-continued

| Shoulder Angle ($S_a$) | $D_c$:$D_p$ Diamond Table Ratio |
|---|---|
| 25° and 35° | 0.45 and 0.55 |
| 30° and 40° | 0.25 and 0.8 |
| 30° and 40° | 0.25 and 0.7 |
| 30° and 40° | 0.35 and 0.6 |
| 30° and 40° | 0.45 and 0.5 |
| 35° and 45° | 0.15 and 0.75 |
| 35° and 45° | 0.25 and 0.65 |
| 35° and 45° | 0.35 and 0.55 |
| 35° and 45° | 0.4 and 0.5 |
| 40° and 50° | 0.1 and 0.8 |
| 40° and 50° | 0.2 and 0.70 |
| 40° and 50° | 0.3 and 0.6 |
| 40° and 50° | 0.4 and 0.5 |
| 45° and 55° | 0.1 and 0.75 |
| 45° and 55° | 0.2 and 0.7 |
| 45° and 55° | 0.3 and 0.6 |
| 45° and 55° | 0.4 and 0.5 |
| 50° and 60° | 0.05 and 0.75 |
| 50° and 60° | 0.15 and 0.65 |
| 50° and 60° | 0.25 and 0.55 |
| 50° and 60° | 0.35 and 0.45 |
| 55° and 65° | 0.05 and 0.7 |
| 55° and 65° | 0.1 and 0.6 |
| 55° and 65° | 0.2 and 0.5 |
| 55° and 65° | 0.3 and 0.4 |

The correlation between shoulder angle ($S_a$) and shoulder width ratio ($S_w$:$D_d$), is displayed in Table 3,below, in which the ratios are approximate.

TABLE 3

| Shoulder Angle (Sa) | Dc:Dp Diamond Table Ratio | Sw:Dd Should Ratio |
|---|---|---|
| 20° and 65° | 0.1 and 0.8 | 0 to about 0.5 |
| 20° and 65° | 0.1 and 0.8 | 0 to about 0.4 |
| 20° and 65° | 0.1 and 0.8 | 0 to about 0.3 |
| 20° and 65° | 0.1 and 0.8 | 0 to about 0.2 |
| 20° and 65° | 0.1 and 0.8 | 0 to about 0.1 |

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Cutting elements according to one or more of the disclosed embodiments may be employed in combination with cutting elements of the same or other disclosed embodiments, or with conventional cutting elements, in paired or other grouping, including but not limited to, side-by-side and leading/trailing combinations of various configurations.

All citations referred herein are expressly incorporated herein by reference.

We claim:

1. An abrasive tool insert, which comprises:

(a) a substrate having a support face that includes:

(1) an inner support table, wherein the inner support table comprises at least one of; a series of concentric grooves, a series of outwardly radiating channels, a series of intersecting channels, a series of outwardly radiating ridges, and a series of substantially parallel raised ridges that extend from said support table;

(2) an outer shoulder having a width, $S_w$, (3) a downwardly sloping interface from said support table to said shoulder which interface has a slope angle, $S_a$; and (b) a continuous abrasive layer integrally formed on said substrate support face, which abrasive layer includes:

(1) a center having a height, $D_c$, (2) a diameter, $D_d$, (3) a periphery having a height, $D_p$, in contact with said shoulder and which periphery forms a cutting edge;

wherein, $S_w$:$D_d$ ranges between about 0.01 and about 0.5; and for each $S_a$ and $S_w$:$D_d$,$D_c$:$D_p$ is selected so as to diminish residual stress in the abrasive layer.

2. The abrasive tool insert of claim 1, wherein said substrate comprises cemented metal carbide.

3. The abrasive tool insert of claim 2, wherein said cemented metal carbide is selected from the group consisting essentially of Group IVB, Group VB, and Group VIB metal carbides.

4. The abrasive tool insert of claim 1, wherein said abrasive layer is selected from the group consisting essentially of diamond, cubic boron nitride, wurtzite boron nitride, and combinations thereof.

5. The abrasive tool insert of claim 3, wherein said abrasive layer is selected from the group consisting essentially of diamond, cubic boron nitride, wurtzite boron nitride, and combinations thereof.

6. The abrasive tool insert of claim 1, wherein said $S_a$ and $D_c$:$D_p$ each has a value corresponding to one of:

for $S_a$ ranging between about 20° and 30°, $D_c$:$D_p$ ranging from between about 0.25 and 0.85;

for $S_a$ ranging between about 20° and 30°, $D_c$:$D_p$ ranging from between about 0.35 and 0.75;

for $S_a$ ranging between about 20° and 30°, $D_c$:$D_p$ ranging from between about 0.45 and 0.65;

for $S_a$ ranging between about 20° and 30°, $D_c$:$D_p$ ranging from between about 0.5 and 0.55;

for $S_a$ ranging between about 25° and 35°, $D_c$:$D_p$ ranging from between about 0.25 and 0.8;

for $S_a$ ranging between about 25° and 35°, $D_c$:$D_p$ ranging from between about 0.3 and 0.7;

for $S_a$ ranging between about 25° and 35°, $D_c$:$D_p$ ranging from between about 0.4 and 0.6, for $S_a$ ranging between about 25° and 35°, $D_c$:$D_p$ ranging from between about 0.45 and 0.55, for $S_a$ ranging between about 30° and 40°, $D_c$:$D_p$ ranging from between about 0.25 and 0.8;

for $S_a$ ranging between about 30° and 40°, $D_c$:$D_p$ ranges from between about 0.25 and 0.7;

for $S_a$ ranging between about 30° and 40°, $D_c$:$D_p$ ranging from between about 0.35 and 0.6;

for $S_a$ ranging between about 30° and 40°, $D_c$:$D_p$ ranging from between about 0.45 and 0.5;

for $S_a$ ranging between about 35° and 45°, $D_c$:$D_p$ ranging from between about 0.15 and 0.75;

for $S_a$ ranging between about 35° and 45°, $D_c$:$D_p$ ranging from between about 0.25 and 0.65;

for $S_a$ ranging between about 35° and 45°, $D_c$:$D_p$ ranging from between about 0.35 and 0.55, for $S_a$ ranging between about 35° and 45°, $D_c$:$D_p$ ranging from between about 0.4 and 0.5, for $S_a$ ranging between about 40° and 50°, $D_c$:$D_p$ ranging from between about 0.1 and 0.8;

for $S_a$ ranging between about 40° and 50°, $D_c$:$D_p$ ranging from between about 0.2 and 0.7;

for $S_a$ ranging between about 40° and 50°, $D_c$:$D_p$ ranging from between about 0.3 and 0.6;

for $S_a$ ranging between about 40° and 50°, $D_c$:$D_p$ ranging from between about 0.4 and 0.5;

for $S_a$ ranging between about 45° and 55°, $D_c$:$D_p$ ranging from between about 0.1 and 0.75;

for $S_a$ ranging between about 45° and 55°, $D_c$:$D_p$ ranging from between about 0.2 and 0.7;

for $S_a$ ranging between about 45° and 55°, $D_c$:$D_p$ ranging from between about 0.3 and 0.6;

for $S_a$ ranging between about 45° and 33°, $D_c$:$D_p$ ranging from between about 0.4 and 0.5;

for $S_a$ ranging between about 50° and 60°, $D_c$:$D_p$ ranging from between about 0.05 and 0.75;

for $S_a$ ranging between about 50° and 60°, $D_c$:$D_p$ ranging from between about 0.15 and 0.65;

for $S_a$ ranging between about 50° and 60°, $D_c$:$D_p$ ranging from between about 0.25 and 0.55;

for $S_a$ ranging between about 50° and 60°, $D_c$:$D_p$ ranging from between about 0.35 and 0.45;

for $S_a$ ranging between about 35° and 65°, $D_c$:$D_p$ ranging from between about 0.05 and 0.7;

for $S_a$ ranging between about 55° and 65°, $D_c$:$D_p$ ranging from between about 0.1 and 0.6;

for $S_a$ ranging between about 55° and 65°, $D_c$:$D_p$ ranging from between about 0.2 and 0.5;

for $S_a$ ranging between about 55° and 65°, $D_c$:$D_p$ ranging from between about 0.3 and 0.4.

7. The abrasive tool insert of claim 6, wherein for $S_a$ ranging between about 20° and 65°, $D_c$:$D_p$ ranges from between about 0.1 and 0.8 and $S_w$:$D_d$ ranges from about 0.01 to about 0.5.

8. The abrasive tool insert of claim 6, wherein $S_w$:$D_d$ ranges from about 0.01 to about 0.4.

9. The abrasive tool insert of claim 6, wherein $S_w$:$D_d$ ranges from about 0.01 to about 0.3.

10. The abrasive tool insert of claim 6, wherein $S_w$:$D_d$ ranges from about 0.01 to about 0.2.

11. The abrasive tool insert of claim 6, wherein $S_w$:$D_d$ ranges from about 0.01 to about 0.1.

12. The abrasive tool insert of claim 1, wherein said sloping interface is curved.

13. An abrasive tool insert, which comprises:

(a) a cylindrical substrate having a support face that ranges from about 6 to about 30 mm in diameter and that includes:

(1) an innersupport table, wherein the inner support table comprises at least one of: a series of concentric grooves, a series of outwardly radiating channels, a series of intersecting channels, a series of outwardly radiating ridges, and a series of substantially parallel raised ridges that extend from said support table, (2) an outer shoulder having a width, $S_w$, (3) a downwardly sloping interface from said support table to said shoulder which interface has a slope angle, $S_a$; and (b) a continuous abrasive layer integrally formed on said substrate support face, which abrasive layer includes:

(1) a center having a height, $D_c$, (2) a diameter, $D_d$, which ranges from about 6 to about 30 mm in diameter, (3) a periphery having a height, $D_p$, that ranges front about 2 to 6 mm and is in contact with said shoulder and which periphery forms a cutting edge;

wherein, $S_w$:$D_d$ ranges between about 0.01 and about 0.5; and for each $S_a$ and $S_w$:$D_d$, $D_e$:$D_p$ is selected so as to diminish residual stress in the abrasive layer.

14. The abrasive tool insert of claim 13, wherein $S_w$ ranges from about 0.003 to about 0.083 mm.

15. The abrasive tool insert of claim 14, wherein said substrate comprises cemented metal carbide.

16. The abrasive tool insert of claim 15, wherein said cemented metal carbide is selected from the group consisting essentially of Group IVB, Group VB, and Group VIB metal carbides.

17. The abrasive tool insert of claim 13, wherein said abrasive layer is selected from the group consisting essentially of diamond, cubic boron nitride, wurtzite boron nitride, and combinations thereof.

18. The abrasive tool insert of claim 13, wherein $S_a$ ranges from about 40° to about 50° and said $D_c$:$D_p$ ranges from about 0.1 to about 0.8.

* * * * *